US008221598B2

(12) United States Patent
Diel et al.

(10) Patent No.: US 8,221,598 B2
(45) Date of Patent: Jul. 17, 2012

(54) SYSTEM FOR PLATING

(75) Inventors: Wolfgang Diel, Wiesbaden (DE); Richard M. Peekema, San Jose, CA (US); Murali Ramasubramanian, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 1237 days.

(21) Appl. No.: 11/560,719

(22) Filed: Nov. 16, 2006

(65) Prior Publication Data

US 2007/0068801 A1 Mar. 29, 2007

Related U.S. Application Data

(62) Division of application No. 10/427,232, filed on Apr. 30, 2003, now Pat. No. 7,156,972.

(51) Int. Cl.
*C25D 17/12* (2006.01)

(52) U.S. Cl. ..... 204/277; 204/290.14

(58) Field of Classification Search ..... 204/290.14, 204/277
See application file for complete search history.

(56) References Cited

U.S. PATENT DOCUMENTS

| | | | | |
|---|---|---|---|---|
| 3,103,474 | A | 9/1963 | Juda et al. | |
| 3,616,327 | A * | 10/1971 | Barendrecht et al. | 205/479 |
| 4,102,756 | A * | 7/1978 | Castellani et al. | 205/82 |
| 4,159,366 | A | 6/1979 | Thaller | |
| 4,422,911 | A * | 12/1983 | Juda et al. | 205/576 |
| 4,444,629 | A * | 4/1984 | Martin | 205/245 |
| 4,765,872 | A * | 8/1988 | Hamano et al. | 205/101 |
| 4,900,406 | A * | 2/1990 | Janssen et al. | 205/138 |
| 5,173,168 | A * | 12/1992 | van Haastrecht et al. | 205/77 |
| 5,683,568 | A | 11/1997 | Harris et al. | |
| 5,883,762 | A | 3/1999 | Calhoun et al. | |
| 5,932,082 | A | 8/1999 | Harris et al. | |
| 6,344,128 | B1 | 2/2002 | Toledo et al. | |
| 6,352,622 | B1 * | 3/2002 | Brown et al. | 204/242 |
| 7,156,972 | B2 | 1/2007 | Diel et al. | |
| 2003/0029726 | A1 * | 2/2003 | Kovarsky et al. | 205/81 |
| 2004/0027715 | A1 * | 2/2004 | Hixson-Goldsmith et al. | 360/110 |
| 2006/0207875 | A1 * | 9/2006 | Lee et al. | 204/275.1 |

FOREIGN PATENT DOCUMENTS

JP 02019500 A 1/1990

OTHER PUBLICATIONS

Crozier et al., "Solubility of Hydrogen in Water, Seawater, and NaCl Solutions" Journal of Chemical and Engineering Data, 19(3) pp. 242-244 (1974).*

Peekema, "Potentiostatic Control of Ferric Ion in a Permalloy Plating Bath" Proc. Symp. Electrochem. Technol. Electron. 88(23) at pp. 553-559 (1987).*

Gabe et al., "Catalytic Anodes for Electrodeposition: A Study for Acid Copper Printed Circuit Board (PCB) Production" Circuit World 32(3) pp. 3-10 (2006).*

Restriction Requirement from U.S. Appl. No. 10/427,232 dated Dec. 7, 2005.

(Continued)

*Primary Examiner* — Harry D Wilkins, III
*Assistant Examiner* — Bryan D. Ripa
(74) *Attorney, Agent, or Firm* — Zilka-Kotab, PC

(57) ABSTRACT

A system for plating according to one embodiment includes a plating cell containing plating solution; an anode in contact with the plating solution; a cathode in contact with the plating solution; and a hydrogen electrode in contact with the plating solution.

20 Claims, 4 Drawing Sheets

OTHER PUBLICATIONS

Non-Final Office Action Summary from U.S. Appl. No. 10/427,232 dated Feb. 1, 2006.

Peekema, "Potentiostatic control of ferric ion in a Permalloy plating bath," Proceedings—Electrochem. Soc. (no month, 1988), vol. 88-23, (Proc. Symp. Electochem.Technol. Electron., 1987), pp. 553-559, abstract only.

Final Office Action Summary from U.S. Appl. No. 10/427,232 dated Jun. 9, 2006.

Notice of Allowance from U.S. Appl. No. 10/427,232 dated Aug. 25, 2006.

* cited by examiner

SYSTEM FOR PLATING

RELATED APPLICATIONS

This application is a divisional of U.S. patent application Ser. No. 10/427,232, filed on Apr. 30, 2003 now U.S. Pat. No. 7,156,972.

FIELD OF THE INVENTION

The present invention relates to plating, and more particularly, this invention relates to a plating system.

BACKGROUND OF THE INVENTION

Electroplating is a common process for depositing a thin film of metal or alloy on a workpiece article such as various electronic components for example. In electroplating, the article is placed in a suitable electrolyte bath containing ions of a metal to be deposited. The article forms a cathode, which is connected to the negative terminal of a power supply, and a suitable anode is connected to the positive terminal of the power supply. Electrical current flows between the anode and cathode through the electrolyte, and metal is deposited on the article by an electrochemical reaction.

Electroplating is widely used in the thin film head industry to fabricate magnetic and non-magnetic materials that constitute the writing part of a read-write head. Magnetic materials with Nickel and Iron are widely used as the write pole (and read shield) materials in thin film heads. Different compositions of nickel and iron provide different properties and hence are suitable for different applications. Other plating materials include cobalt-iron compositions.

During plating, it is desirable to obtain the purest volume of magnetic material possible. If impurities such as iron hydroxide or iron oxide are present during plating, the purity of the resulting magnetic material is reduced, with a resulting reduction in the maximum flux obtainable.

The current state of the art has shifted towards material with a high iron content and the resulting high magnetic moment. To raise the iron content in the deposit, however, more iron must be used in the plating solution. More iron in the bath means more ferric ions ($Fe^{3+}$). The ferric ion content of plating baths containing iron can adversely influence both the rate and nature of the metal deposits.

Ferric ions are created by oxidation of ferrous iron ($Fe^{2+}$) in the plating solution. For example, air oxidation of the ferrous iron results in a continuing buildup of ferric ion in the plating solution. Ferric ions can also react with dissolved oxygen in the plating solution to form ferric ions.

Ferric ions are harmful in that they can form iron hydroxide or iron oxide, which precipitates as particulate matter. Particulate matter, as known to those skilled in the art, affects the purity of the plating deposits, and thus its magnetic characteristics.

Ferric ions also affect the rate of plating. Ferric ions react with electrons at the wafer surface and return (are reduced) to ferrous ions. This consumes power, reducing current efficiency. The result is inconsistent quality and quantity, as the amount of electrons consumed for this side reaction will vary with the concentrations of $Fe^{3+}$ in the bath. For example, assume the plating bath is used regularly on a daily basis, but is left idle for a period of time. A high level of $Fe^{3+}$ will have formed over the idle period due to the prolonged exposure of the plating solution to air and lack of electrolytic reduction of $Fe^{3+}$. Thus, the level of $Fe^{3+}$ when plating is resumed will be much higher than the level at which plating was discontinued.

Consequently, the current efficiency changes with idle time due to the variation in current being used up for ferric reduction. When $Fe^{3+}$ reduces on the wafer surface, products of the reaction may become incorporated in the wafer structure. In addition, when plating Ni and Fe, ferric hydroxide particles are suspended in the plating solution. Those can also get incorporated, which rapidly reduces magnetic film quality.

The prior art has made many attempts to control the ferric content in plating solutions. The usual practice is to allow the ferric to build up until it precipitates. The precipitate is continuously collected on a sub-micron filter through which the plating solution is circulated. One disadvantage of this approach is that the filter quickly becomes clogged. Further, the ferric ion content is always high, i.e. at saturation, and thus the problems mentioned above remain present.

Another practice is to introduce a complexing agent to keep the ferric ions in soluble form, and avoid precipitation. One drawback to this method is that the ferric content continues to build up over time, resulting in an increase in ferric ion reaction on the wafer. The current efficiency and therefore the plating rate thus decrease over time.

Another practice used to mitigate the ferric problem is to blanket the bath with nitrogen to prevent the air oxidation of the ferrous ions. This is not completely successful, because the bath is circulated out to plating cells which cannot conveniently be operated under a nitrogen blanket.

The potentiostatic reduction of the ferric has also been employed, but it requires complex instrumentation including a reference electrode, and a sacrificial anode which will not cause the oxidation of ferrous ions to ferric ions.

What is therefore needed is a way to not only reduce the ferric ion content in a plating bath, but also a way to do so efficiently.

SUMMARY OF THE INVENTION

A system for plating according to one embodiment includes a plating cell containing plating solution; an anode in contact with the plating solution; a cathode in contact with the plating solution; and a hydrogen electrode in contact with the plating solution.

A system for plating according to another embodiment includes a plating cell containing plating solution for plating iron to a substrate; a plating reservoir for storing plating solution; piping fluidly connecting the cell and plating reservoir; an anode in contact with the plating solution; a cathode in contact with the plating solution; and a hydrogen electrode in contact with the plating solution, wherein the electrode is positioned in at least one of the plating cell, the plating reservoir, and the piping.

A system for plating according to yet another embodiment includes a plating cell containing plating solution; a source of a magnetic field; an anode in contact with the plating solution; a cathode in contact with the plating solution; and a hydrogen electrode in contact with the plating solution, wherein hydrogen is exposed to the electrode in the presence of the magnetic field.

In one embodiment, the electrode has a platinum surface. For example, the electrode hay have a platinized titanium electrode.

Hydrogen may be bubbled over the electrode. In addition or alternatively, hydrogen may be added to the plating solution, the hydrogen dissolving into the plating solution.

A system in one embodiment includes a filter housing coupled to at least one of the plating cell, a plating reservoir coupled to the plating reservoir, and piping coupled to the plating reservoir, wherein the electrode is positioned in the filter housing.

A system in one embodiment includes a mechanism for increasing a circulation of the plating solution near the electrode.

In one embodiment, the electrode is positioned in a plating reservoir. In another embodiment, the electrode is positioned in the plating cell.

The plating solution may comprise a composition allowing plating of iron to a substrate.

A source of a magnetic field may be provided, wherein hydrogen is exposed to the electrode in the presence of the magnetic field.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the present invention, as well as the preferred mode of use, reference should be made to the following detailed description read in conjunction with the accompanying drawings.

BEST MODE FOR CARRING OUT THE INVENTION

The following description is the best embodiment presently contemplated for carrying out the present invention. This description is made for the purpose of illustrating the general principles of the present invention and is not meant to limit the inventive concepts claimed herein.

Figure 1:
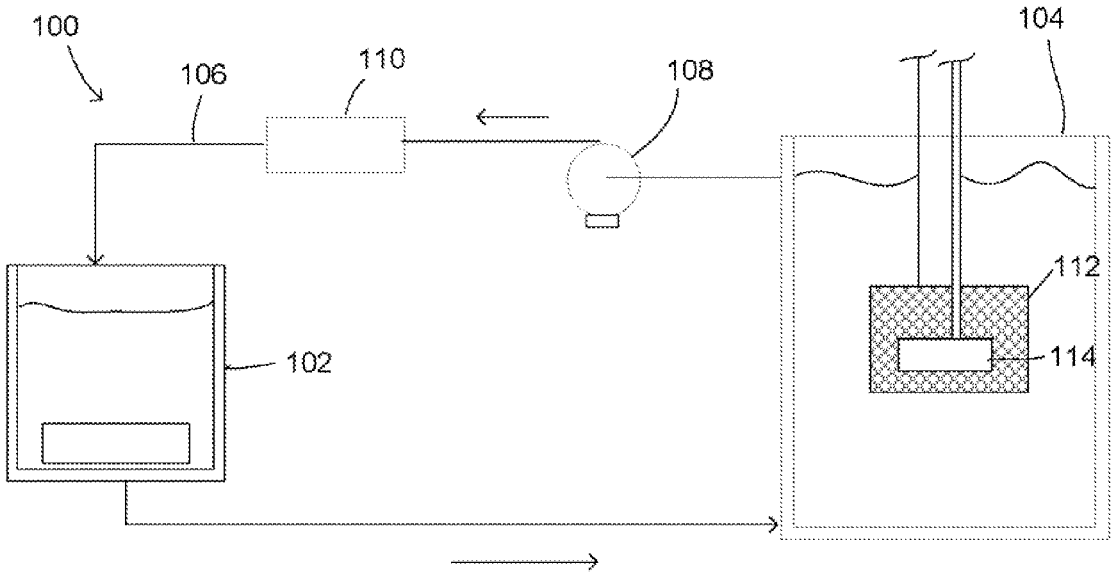
FIG. 1 is a cross sectional system diagram of a plating system according to one embodiment

FIG. 1 illustrates a plating system 100 according to an illustrative embodiment of the present invention. As shown, the system 100 includes a plating cell 102, a plating reservoir 104, and a piping system 106 with a pump(s) 108. A filter 110 for removing particulate matter may also be included somewhere in the system 100, such as in the piping system 106.

Figure 2:
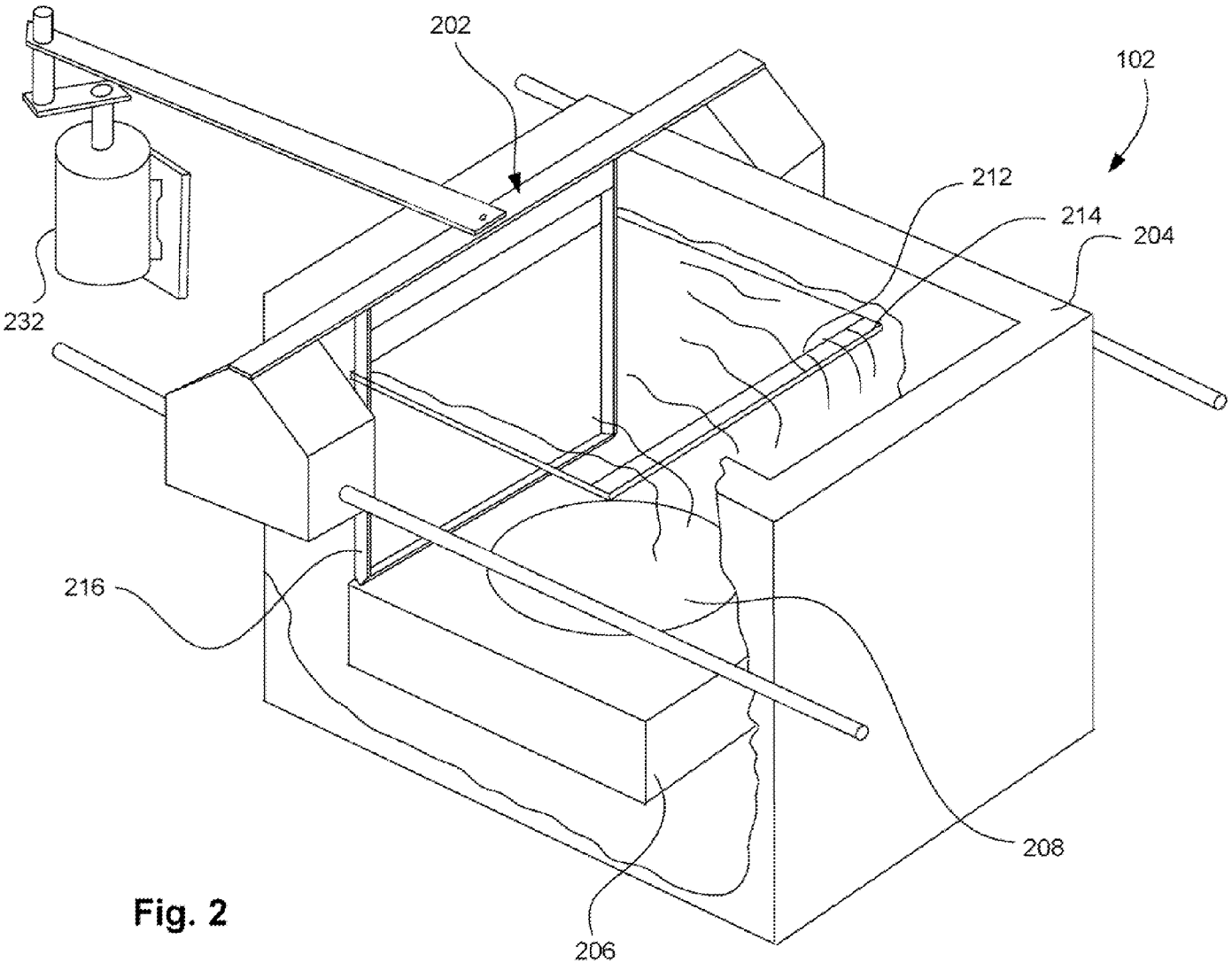
FIG. 2 is a perspective view of a plating cell according to one embodiment.

FIG. 2 depicts an illustrative plating cell 102 having a paddle assembly 202. The plating of nickel-iron alloys is performed in a container 204. The walls of the container 204 can be composed of a dielectric material such as glass or a plastic such as polymethacrylate. Positioned in the container 204 is a cathode 206. The cathode 206 may be composed of a metal plate plater's tape composed of an insoluble polymer adhesively secured to the exterior thereof on the edges and lower surface to protect it from the electroplating bath and thus giving a very well defined current density and current density distribution. A substrate 208 to be plated is positioned in a depression 210 (FIG. 3) in the cathode 206. Note that the term "substrate" as used herein may be a clean base upon which material is deposited, or can be a previously/partially formed wafer. Substrate materials may include, for example, 1¼ inch diameter sapphire, garnet, various ceramics or Si wafers covered with thermal $SiO_2$ and metallized with 50 A to 100 A of Ti and 100 A to 1000 A of Cu, Permalloy alloy, Au, etc.

An anode 212 is also positioned in the container 204 and may be composed of wire mesh screening. The anode 212 may also be composed of inert platinum, solid nickel or of a combination of an inert Pt sheet and a Ni wire mesh.

The plating solution in the bath may be any combination of Ni, Co, Fe, or any other material. The bath level during plating is above the anode 212, so the anode 212 is immersed in the bath during plating. The bath level is held relatively constant by a solution overflow 214 over which the solution flows. The bath is constantly replenished and its temperature is controlled by recirculation from a reservoir (not shown) where it is refreshed by dispensing acid, iron and preferably also Na Saccharin, Na lauryl sulfate and/or [$Ni^{++}$] if needed and constantly stirred by a reciprocating mixer 216 otherwise referred to herein as a paddle 216, which travels back and forth above the surface of cathode 206 at an approximate distance of 1/32 to ⅛ inch for providing agitation of the bath, preferably with minimal turbulence.

Figure 3:
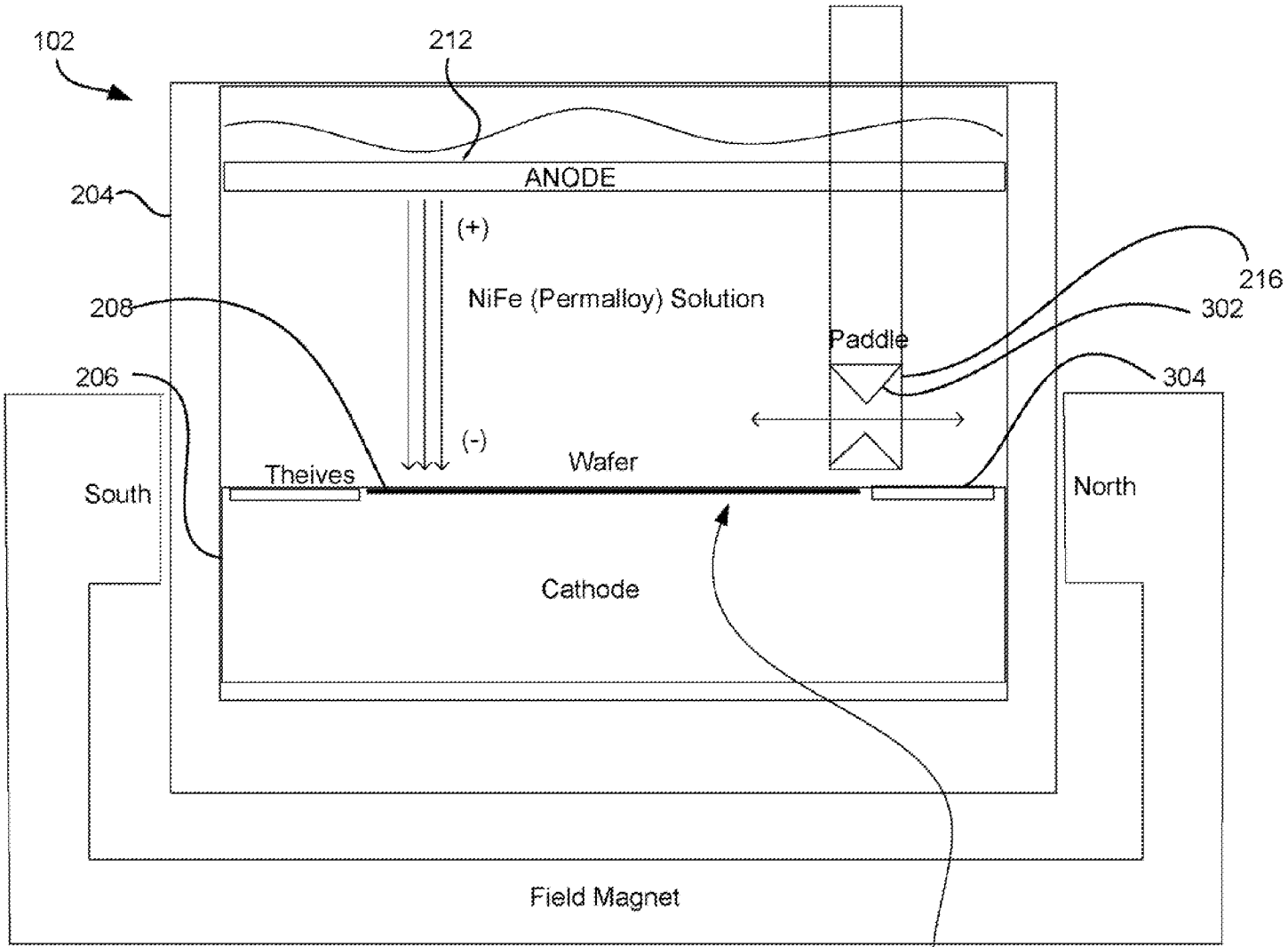
FIG. 3 is a cross sectional view of a plating cell according to one embodiment.

As shown in FIG. 3, the paddle 216 in this exemplary embodiment is in the exemplary form of a pair of vertically elongate, triangular (45°-90°-45°) blades 302 having spaced apart, parallel apexes defining therebetween a slot through which the fluid is flowable. The blades 302 of the paddle 216 have oppositely facing, parallel, flat bases with one of the bases being disposed parallel to and closely adjacent to the substrate 208.

Preferably, the paddle travels at a constant velocity over the object being plated to provide the most uniform film deposition. Thus, a programmable motor can be used, such as a rotary motor with a worm screw, or a linear conversion actuator. These mechanisms provide a generally trapezoidal velocity profile. Consequently, layer of films produced in the electroplating cell of this embodiment are uniformly thick throughout, and where metal alloys are being plated, the metal compositions of particular layers will also be uniform over the entire film.

Referring again to FIGS. 2 and 3, when the motor 232 is energized, the paddle 216 is driven back and forth over the length of the 208, with acceleration and deceleration on preferably occurring over thieves 304, also known as deflectors, on the cathode 206.

The speed of the cycle (one pass of the paddle 216 forward and back) can be changed by varying the rotation speed of the motor 232.

Using equipment such as that shown in FIGS. 1-3 for electrodeposition (electroplating), multiple layers of magnetic materials with varying composition can be deposited front a single plating bath by changing the deposition conditions. By controlling the plating conditions, the composition of the materials deposited on the substrate can be manipulated to produce alloys of different composition, and hence different magnetic moments. Prior to actual plating, the plating conditions that produce the desired alloy composition are determined experimentally for the particular type of plating equipment being used. These conditions can then be programmed into the controller.

As discussed in detail above, the ferric ion content of plating baths containing iron influences the rate and nature of the metal deposits. Air oxidation of the ferrous iron results in a continuing buildup of ferric ion in the bath.

Referring again to FIG. 1, a metal electrode 112, preferably having at least a platinum surface, is introduced into the bath over which hydrogen is bubbled, according to one embodiment of the present invention. The introduction of this 'hydrogen' electrode into the bath provides a surface on which ferric ions ($Fe^{3+}$) are electrochemically reduced to ferrous ions ($Fe^{2+}$) very efficiently. Preferably, the potential of this surface never gets negative enough to plate out iron, cobalt or nickel, and therefore does not interfere with the other constituents of the bath. By keeping the ferric content under control, the precipitation of ferric hydroxide is avoided, and filters will last almost indefinitely. Also, the current efficiency, and therefore the plating rate of the bath will be more stable and consistent. This scheme also displaces dissolved oxygen to a certain extent, further reducing conversion of ferrous ions to ferric ions.

An expanded (i.e., mesh) titanium metal electrode that is platinized on the surface works very well as the electrode 112 due to its large surface area. It is physically robust, minimizes the cost by minimizing the amount of platinum, and is readily available. A gas sparger 114 can be used to bubble the hydrogen over the electrode 112. Alternatively, hydrogen can be introduced into the bath in general where the natural solubility of hydrogen in aqueous solutions may supply enough for this purpose (depending on the composition of the plating solution, of course). In addition, the electrode 112 can be charged with hydrogen by energizing it as the cathode in a separate circuit with an acceptable sacrificial anode.

The electrode 112 can be placed in the plating cell 102 and/or the plating reservoir 104. Preferred placement is in the plating reservoir 104. As an alternative to using a standalone electrode or in combination therewith, a platinum gauze electrode can be placed in the filter housing 110 or piping, where circulation would be significant. Hydrogen can be sparged into the flow of plating solution ahead of the gauze electrode, and/or can be introduced into the bath in general where the natural solubility of hydrogen in aqueous solutions may supply enough for the purpose.

Figure 4:
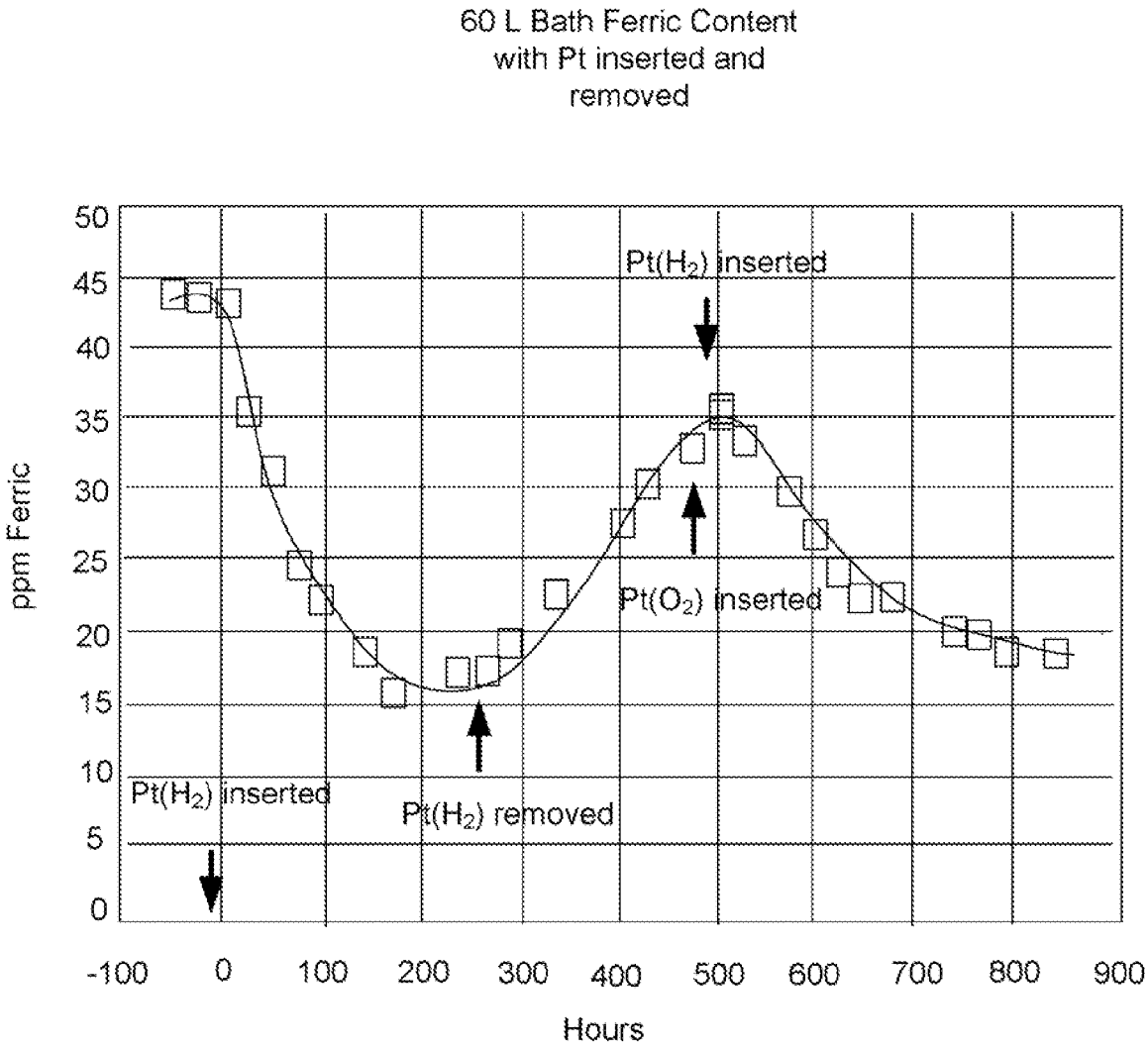
FIG. 4 is a graph depicting the effect of a platinized electrode on the ferric content in a plating solution in the presence of hydrogen.

FIG. 4 graphically illustrates an exemplary effect of a platinized titanium electrode on the ferric content in a plating solution (20/80 NiFe). More particularly, FIG. 4 shows that when hydrogen is introduced over the platinum electrode, the ferric content is reduced, and when the hydrogen is removed or when oxygen is introduced, the ferric content increases. The ferric content was measured spectrophotometrically as the thiocyanate complex during the course of gathering this data.

As shown in FIG. 4, the ferric content at 0 hours is about 45 ppm ferric icons. After insertion of the electrode at 0 hours, the Fe3+ in the plating bath is lowered from 45 ppm to about 15 ppm by 175 hours. During the first 50 hours, the ferric change is about 5.8 ppm/day. When hydrogen is introduced from hours 70 to 150, the ferric reduction rate is 2.3 ppm/day.

At 250 hours, the hydrogen supply to the electrode is removed, and consequently, the ferric content increases. During hours 250 to 450, the rate of ferric production is estimated as approximately 1.7 ppm/day, due to the air oxidation of ferrous ions during the normal circulation of the bath. At 450 hours, oxygen is bubbled over the electrode to raise the ferric content. At 500 hours, the electrode is reintroduced with hydrogen, and again the ferric content decreases over time. From 500 to 650 hours, the ferric reduction rate is at about 2.4 ppm/day, which is close to the results from hours 70 to 150. Eventually, the ferric content levels off between 15 and 20 ppm, where the rate of production and the rate of reduction are the same.

Obtaining lower ferric levels in the bath is possible by increasing the area of the platinum electrode, and/or increasing the circulation of the bath near the electrode.

The methods of ferric control described above are even more useful in baths that have even higher iron content, such as cobalt iron baths. Using the embodiments of the invention disclosed herein, it is possible to control the ferric content to almost any specified level. This is a significant advantage over a system that allows the ferric to drift and seek its saturation level, or that requires periodic chemical intervention.

The inclusion of ferric hydroxide in the plated film is sometimes thought to be the cause of poor electrodeposits, and this problem would also be avoided by the use of this invention.

While various embodiments have been described above, it should be understood that they have been presented by way of example only, and not limitations. Thus, the breadth and scope of a preferred embodiment should not be limited by any of the abovedescribed exemplary embodiments, but should be defined only in accordance with the following claims and their equivalents.

What is claimed is:

1. A system for plating, comprising:

a plating cell adapted for containing plating solution;

a plating reservoir adapted for containing the plating solution;

a piping system for transferring the plating solution from the plating reservoir to the plating cell;

an anode in the plating cell for contacting the plating solution;

a cathode in the plating cell for contacting the plating solution;

a hydrogen electrode in the plating reservoir for contacting the plating solution, the hydrogen electrode providing a surface on which ferric ions are electrochemically reduced to ferrous ions; and a mechanism for bubbling hydrogen over the hydrogen electrode in the plating reservoir.

2. The system as recited in claim 1, wherein the electrode has a platinum surface.

3. The system as recited in claim 2, wherein the electrode is a platinized titanium electrode.

4. The system as recited in claim 1, wherein hydrogen is bubbled over the electrode.

5. The system as recited in claim 1, wherein hydrogen is added to the plating solution, the hydrogen dissolving into the plating solution.

6. The system as recited in claim 1, further comprising a filter housing coupled to at least one of the plating cell, the plating reservoir, and piping coupled to the plating reservoir, wherein a second hydrogen electrode is positioned in the filter housing.

7. The system as recited in claim 1, further comprising a mechanism for increasing a circulation of the plating solution near the electrode.

8. The system as recited in claim 1, wherein the electrode is a platinized titanium electrode, and further comprising a source of a magnetic field positioned outside the plating cell, the magnetic field emanating into the plating cell.

9. The system as recited in claim 1, wherein a second electrode is positioned in the plating cell.

10. The system as recited in claim 1, further comprising a second hydrogen electrode in piping coupled to the plating reservoir.

11. The system as recited in claim 9, further comprising a source of a magnetic field, wherein hydrogen is exposed to the electrode in the presence of the magnetic field.

12. A system for plating, comprising:

a plating cell adapted for containing plating solution for plating iron or an alloy thereof to a substrate;

a plating reservoir for storing plating solution;

piping fluidly connecting the plating cell and plating reservoir;

an anode in the plating cell for contacting the plating solution;

a cathode in the plating cell for contacting the plating solution; and a hydrogen electrode in the piping for contacting the plating solution, the hydrogen electrode providing a surface on which ferric ions are electrochemically reduced to ferrous ions; and an inlet for introducing hydrogen ahead of the hydrogen electrode.

13. The system as recited in claim 12, wherein the electrode has a platinum surface.

14. The system as recited in claim 12, wherein hydrogen is bubbled over the electrode.

15. The system as recited in claim 12, wherein the hydrogen is added to the plating solution, the hydrogen dissolving into the plating solution.

16. The system as recited in claim 12, further comprising a filter housing coupled to at least one of the plating cell, a plating reservoir coupled to the plating cell, and piping coupled to the plating reservoir, wherein a second hydrogen electrode is positioned in the filter housing.

17. The system as recited in claim 12, wherein the electrode is a platinized titanium electrode, and further comprising a source of a magnetic field positioned outside the plating cell, the magnetic field emanating into the plating cell.

18. The system as recited in claim 12, further comprising a second hydrogen electrode positioned in at least one of the plating cell and plating reservoir.

19. A system for plating, comprising:

a plating cell adapted for containing plating solution;

a plating reservoir adapted for containing the plating solution;

piping coupling the plating cell to the plating reservoir;

a filter housing coupled to at least one of the plating cell, the-plating reservoir, and the piping;

a source of a magnetic field positioned outside the plating cell, the magnetic field emanating into the plating cell;

an anode in the plating cell for contacting the plating solution;

a cathode in the plating cell for contacting the plating solution;

a hydrogen electrode in at least one of the plating cell and a plating reservoir for contacting the plating solution, the hydrogen electrode providing a surface on which ferric ions are electrochemically reduced to ferrous ions; and a mechanism for exposing hydrogen to the electrode.

20. The system as recited in claim 19, wherein the plating solution comprises a composition allowing plating of iron to a substrate, wherein the electrode is a platinized titanium electrode.

* * * * *

UNITED STATES PATENT AND TRADEMARK OFFICE

CERTIFICATE OF CORRECTION

PATENT NO. : 8,221,598 B2
APPLICATION NO. : 11/560719
DATED : July 17, 2012
INVENTOR(S) : Diel et al.

It is certified that error appears in the above-identified patent and that said Letters Patent is hereby corrected as shown below:

col. 1, line 49, replace “Ferric” with --Ferrous--;

col. 1, line 61, replace “concentrations” with --concentration--;

col. 2, line 61, replace “hay” with --may--;

col. 3, line 58, replace “metal plate plater’s tape” with --metal plate having plater’s tape--;

col. 4, line 35, replace “layer” with --layers--;

col. 4, line 51, replace “front” with --from--;

col. 5, line 45, replace “icons” with --ions--;

col. 6, line 12, replace “limitations” with --limitation--;

col. 6, line 14, replace “abovedescribed” with --above-described--.

Signed and Sealed this
Eighteenth Day of September, 2012

David J. Kappos

David J. Kappos
*Director of the United States Patent and Trademark Office*